US006662072B2

(12) United States Patent
Berne et al.

(10) Patent No.: US 6,662,072 B2
(45) Date of Patent: Dec. 9, 2003

(54) GRINDING PROCESS AND CONTROL DEVICE FOR A KNIFE SHAFT

(75) Inventors: Olivier L. Berne, Saint-Marcel (FR); Frederic J. Gaudiller, Nanton (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/184,392

(22) Filed: Jun. 27, 2002

(65) Prior Publication Data

US 2003/0019338 A1 Jan. 30, 2003

(30) Foreign Application Priority Data

Jul. 4, 2001 (FR) ..... 01 08833

(51) Int. Cl.[7] ..... G06F 19/00; B24B 49/18

(52) U.S. Cl. ..... 700/164; 83/364; 83/370; 451/10; 451/45; 451/242; 451/397

(58) Field of Search ..... 700/164; 451/10, 451/45, 242, 397, 419; 83/364, 370, 497, 174

(56) References Cited

U.S. PATENT DOCUMENTS 5,365,821 A * 11/1994 Munier et al. ..... 83/500
5,373,766 A * 12/1994 Ranly et al. ..... 83/497
5,435,217 A * 7/1995 Kato et al. ..... 83/174
6,158,316 A * 12/2000 Ichikawa et al. ..... 83/74
6,503,135 B2 * 1/2003 Clauss et al. ..... 451/419

FOREIGN PATENT DOCUMENTS

EP 0 602 655 A 6/1994
JP 10156676 6/1998

* cited by examiner

*Primary Examiner*—Albert W. Paladini
(74) *Attorney, Agent, or Firm*—David A. Novais

(57) ABSTRACT

The present invention relates to a process and control device to grind a knife shaft used in a machine intended for cutting sheets of materials into strips, for example, sheets of paper, plastic, plates of photosensitive film or any other material having the form of thin sheets. The process includes determining the actual differences of position of the knives of the knife shaft in relation to a theoretical position and then dividing these differences to cut the film strips by widths practically equal to one another, and determining the quantities of material to be eliminated by grinding for each knife. This process especially finds its principal application in the photographic industry, in particular on grinding machines for the knives of knife shafts equipping the film slitters.

8 Claims, 6 Drawing Sheets

GRINDING PROCESS AND CONTROL DEVICE FOR A KNIFE SHAFT

This is a U.S. original application which claims priority on French patent application No. 0108833 filed Jul. 4, 2001.

FIELD OF THE INVENTION

The present invention relates to a process for grinding a knife shaft and the control device linked to the implementation of the process. The knife shaft is used in a machine intended for cutting sheets of material into strips, for example, sheets of paper, plastic, plates of photosensitive film or any other material having the form of thin sheets.

BACKGROUND OF THE INVENTION

In the photographic industry, to obtain several strips of photosensitive film from an initial strip of large width, slitters are used comprising many rotary knives mounted in spaced apart manner on a first knife shaft, and many counter-knives mounted on a second knife shaft, with the strip to be cut running between these two rows of knives and counter-knives. In place of knife shafts, independent units can be used carrying the knives or counter-knives. It is necessary that the knives and counter-knives be sharpened regularly to maintain a good quality of cut on the edge of the cut strips.

There already exist many means that enable the taking into account of the sharpening done on the knives of various slitters, by compensating dimensionally using appropriate means, for the loss of material due to the sharpening of one or more knives. These compensation means enable sufficiently good control of the cutting process to be kept over time, following successive sharpening of the knives. This control of the cutting process produces a sufficiently good cutting quality of the cut strips and little dimensional variability of these cut strips. However, this dimensional variability remains excessive compared with the specifications of film strips used in the photographic industry.

U.S. Pat. No. 4,592,259 describes a method and means for adjusting the relative positioning of the slitter knives of a strip cutting apparatus; in order to obtain a correct relative position of the knives one with another, and between each of the cutting units taking these knives; the cutting units can move on slides. Electrical and mechanical means enable automatic compensation for the dimensional variations of thickness of the knives in time. These compensations produce adjustments of the position of the cutting units one with another on their slides. The objective is to obtain a constant and specified distance between the cutting edges of two successive knives, by comparison with a standard reference value recorded in a memory, and corresponding, for example, to the thickness of a new blade. This invention enables a constant distance between the knives to be obtained, but this concerns knives belonging to slitters or carriages that are independent one from another as to their relative movements on their respective slides. In other words, the overall geometry of the cutting means modifies according to the dimensional variations of the knives, to keep constant the distance between the cutting units and therefore between the cut edges of the knives.

U.S. Pat. No. 4,607,552 describes an apparatus enabling automatic control of the position of many slitters that cut a moving strip. Electronic control means enable, from the measurement of wear of the cutting blades of each slitter, calculation of the dimensional compensation to correctly reposition the blade, relative to the strip to be cut and to the part acting as the counter-knife. This apparatus thus enables compensation of the wear of each of the slitter's blades, independently one from another.

The object of the invention disclosed in U.S. Pat. No. 5,097,732 has certain similarities with that of U.S. Pat. No. 4,607,552. A numerical control device enables the measurement and control of the interval between the cutting units of a slitter having many cutting units. The objective of the invention is to be able to move many cutting units simultaneously to a preset position. Then after this movement of the cutting units, the respective adjustment of the contact pressures of the upper and lower knives is carried out.

U.S. Pat. No. 4,072,887 discloses an apparatus enabling the movement of mobile elements, especially a first pair of circular cutting blades working together having their axes parallel, into a new position, through a translation according to the axis of the circular cutting blades. The apparatus enables the repositioning, using appropriate measuring means, of successive pairs of blades located side by side on independent units, compared with the first pair of blades moved.

European Patent Application 0,602,655 describes a sharpening method for circular cutting blades attached to a shaft. This invention especially aims to not remove the blades from the same knife shaft to sharpen them and so avoid inducing causes of error and thus dimensional variations linked to the remounting operation of these blades on their shaft after their sharpening. The sharpening operation described in this invention especially enables, from the knife shaft comprising its blades to be sharpened and mounted between points on a grinder, to plunge one or more rotating grinding wheels towards the edges of the blades by ensuring the movement of the grinding wheel with a numerically controlled programmed device. This is in order to sharpen successively or simultaneously the cutting blades of the same shaft without removing the blades. The final objective being to improve the lateral and radial run-out of the blade cutting edges by increasing the precision obtained on the cut strips of product. However, the result obtained as to the strip widths of product cut with the knife shafts sharpened according to this sharpening method remains unsatisfactory.

French Patent Application 9912181 relates to a device and a process to position many knives mounted on a first knife shaft in relation to many counter-knives mounted on a second knife shaft of the same strip slitter. This does not enable ensuring especially the dimensional constancy or reproducibility of the pitch on a given slitter.

All the means described in the above mentioned documents are based on principles and means of control or measurement enabling the positioning or repositioning one against the other, of cutting units or slitters comprising knives, to compensate for example for the parameters of variability of the cutting process. The purpose of this is to conserve overall control of the process. In the case of slitters, an important variability parameter of the known process is the wear of the knife blades used on these machines. This phenomenon can be controlled by acting on certain physical components of the slitter, for example, by moving them one in relation to the others to compensate for example for the wear of the knives. It is possible on the same slitter to change, for example, the type of manufacture and proceed to remove the knives corresponding to a first type of manufacture to replace them by other knives corresponding to a new planned manufacture. Then later, for example, all or part of the knives corresponding to the first type of manufacture may be reused. In this case, appropriate control and measuring means enable the control and repositioning if necessary of the knives one in relation to the others; but the guarantee of the reproducibility of the axial pitch between the knives is not assured when sharpening; consequently the quality of the cut obtained by a good correspondence or good pairing of the respective knives of the two knife shafts working together to cut, for example, the same strip of material is not assured. In other words, the means used in the prior art mentioned enable control of the cutting process but without controlling the reproducibility or the variability of the cutting pitch of the knife shaft.

SUMMARY OF THE INVENTION

An object of the present invention is to control the evenness of sharpening the knife shafts of the same slitter, and more precisely pairs of knife shafts equipped with knives, so that over time and with successive sharpening or grinding, these knife shafts, for a specified cutting width, have a pitch between their respective knives that is perfectly controlled and even along with the grinding; which guarantees good pairing of the two shafts. Thus advantageously special additional adjustments of one shaft in relation to the other on the slitter taking these two shafts are prevented; all without generating dimensional drift or scatter of the various cutting pitches in time. The present invention enables a robust grinding process to be obtained and maintained, while making productivity gains, as the grinding of the knife shafts is done in concurrent time on a special grinding machine. For a given pair of knife shafts, initial adjustments of the slitter are no longer necessary, as the two paired knife shafts of the same slitter will have knives that stay well positioned one in relation to the other, during successive grinding. Thus what is obtained is not only excellent mastery of the precision of the specified cut width, but also and above all a better cut due to at least the control of the variability of the axial pitch between the various knives; this enables dimensional evenness of the knife shafts to be obtained along with the grinding. It is even possible to contemplate interchangeability between the knife shafts of different pairs of knife shafts, given the precision level and low dimensional variability obtained with the process according to the invention.

One advantage of the process according to the invention is that it is independent of the variability parameters, e.g. mechanical, due to the grinding machine.

Another advantage of the process according to the invention is that it enables keeping good geometric positioning of the knives and a constant pitch independently from variations of the physical parameters linked to the grinding machine's environment. One of these parameters is, for example, the ambient temperature.

The usefulness of this process is precisely being able to correct each knife of a knife shaft by evening up the dimensions of the individual pitches between two consecutive knives without depending on the variability of the grinding machine's mechanical components.

The present invention relates to a grinding process of many knives placed on the periphery of a knife shaft, a process characterized by the following steps:

a) define the difference of the actual position of each knife in relation to a reference position corresponding to the theoretical positions of the knives, by determining for each different pair of consecutive knives of the knife shaft the algebraic value of the difference between the actual pitch measured between two consecutive knives and the theoretical pitch;

b) calculate the average algebraic value of the algebraic values of the differences between the actual pitch and the theoretical pitch determined at step a), by dividing the sum of said algebraic values of the differences by the total number of different pairs of consecutive knives of the knife shaft;

c) determine the algebraic value corresponding to a first corrected relative position of each knife, by removing said average algebraic value of the differences calculated at step b) from each of the algebraic values of the difference between the actual pitch and the theoretical pitch determined at step a);

d) determine the algebraic value of the difference between the total actual length between the two end knives of the knife shaft, and the total theoretical length of the knife shaft calculated by multiplying the total number of different pairs of consecutive knives by the value of the theoretical pitch;

e) determine the algebraic value of the difference for the length per knife by dividing the algebraic value of the difference between the total theoretical length and the total actual length obtained at step d) by the total number of knife pairs of the knife shaft;

f) determine the algebraic value corresponding to a second corrected relative position of the knives by adding the algebraic value of the difference for the length per knife to the algebraic values corresponding to the first corrected relative position; and g) from the sum of the algebraic values of the second corrected relative position, determine the quantities of material to be removed per knife.

Other characteristics will appear on reading the following description, with reference to the drawings.

DETAILED DESCRIPTION OF THE INVENTION

In the description, use of the term "knife" is taken to mean both the knives and the counter-knives.

Figure 1:
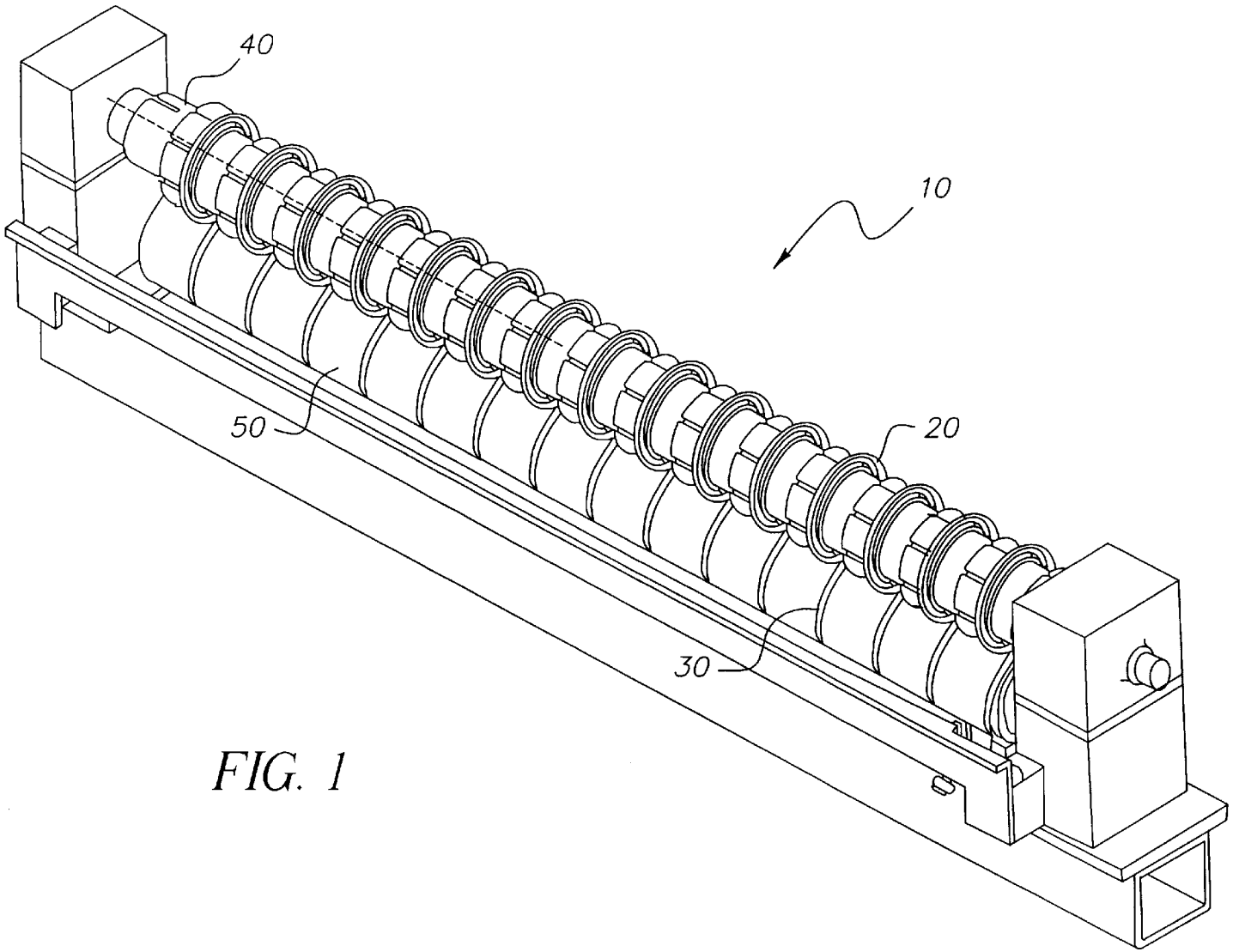
FIG. 1 represents the general view of a strip slitter.
Figure 2A:
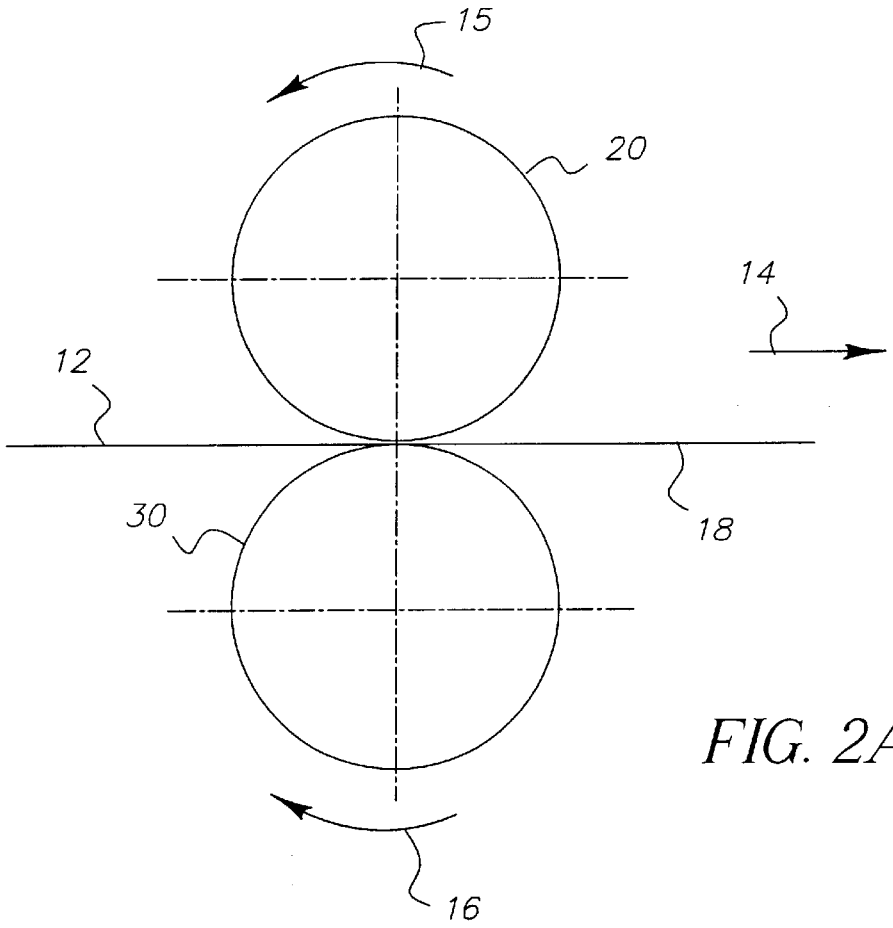
FIGS. 2A and 2B represent diagrams of the cutting operation principle carried out by the knife shafts of a slitter.
Figure 2B:
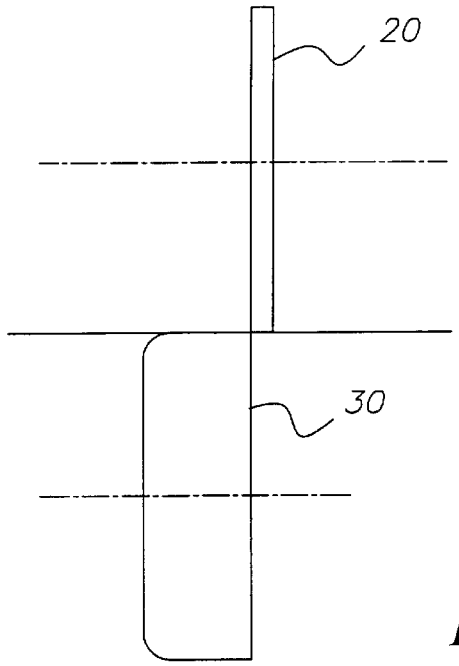

FIG. 1 represents a slitter or cutting unit 10 that enables sheets of material to be cut into strips, like for example, photographic film plates, that have to be cut into strips with high precision. Such a slitter comprises two shafts 40 and 50 on which are mounted respectively rotary knives 20 and counter-knives 30. The two shafts 40 and 50 are mounted so that their main axes are parallel. These elements 20 and 30 have the specialty of being circular shaped and they are placed on the periphery of the knife shaft 40, 50 in order to enable continuous cutting, when the two shafts 40, 50 turn together, their respective axes being parallel. To cut a sheet of material, cutting is based on the principle of scissors according to the principle represented in FIGS. 2A and 2B. The sheet of material to be cut 12 runs in direction 14 between the rotary knives 20 and the counter-knives 30, in for example, the respective directions of rotation 15 and 16; after passing between the cutting elements 20 and 30, the sheet 12 is cut and transformed into strips 18. Generally, the knives are regularly spaced on the slitter to cut film strips of the same width 19 (FIG. 3A), or they can be spaced irregularly to obtain strips of different widths. But in all cases, the objective is to control the variability of these cutting width dimensions, to try to limit adjustments on the slitter and reduce the complexity of the knife grinding operations; while keeping correct evenness or reproducibility of the pitch between two consecutive knives, and for a set strip width 19.

An objective of the process according to the present invention is also to be able to pair up with the minimum adjustment or even without adjustment, the knife shafts on a slitter, and to do this with maximum precision and cutting quality linked to this precision. In the manufacture of photographic film, whether for example film used in professional cinema or amateur film cartridges, the cutting operation is important. Later correct perforation directly depends on this. A simple variation in film width causes random and inaccurate perforation and thus a finished product of less quality that disappoints the customer when he/she uses, for example, the film strip in projectors or cameras. Today in the field of photographic film cutting, the precision required in terms of geometric variations on the cut strip width is in the order of a micrometer. This precision corresponds to controlling the variability of the strip width to be cut and its cut quality, these being a direct consequence of correct prior relative positioning of the respective knives 20, 30 of the two shafts 40, 50 of the slitter 10. According to FIG. 3A, the process according to the invention enables this evenness or control of the reproducibility of the axial pitch P between knives to be produced, to obtain a pitch variability P between two consecutive knives practically less than two micrometers (0.002 mm), while ensuring correct pairing of the respective knives 20, 30 of the shafts 40, 50 of the slitter 10. According to FIGS. 3A and 3B, the pairing corresponds to the axial play A between the faces of the knives 20 and 30 positioned in the slitter 10. The knife shafts 40, 50 are pre-positioned one in relation to the other with spacers so that the first respective knives 20, 30 of each knife shaft 40, 50 are positioned one in relation to the other according to a correct relative axial position characterized by the axial play A. The process according to the invention also enables control of this axial play for all the knives 20, 30 with high precision, i.e. variability in the order of 0.01 mm maximum.

Figure 4:
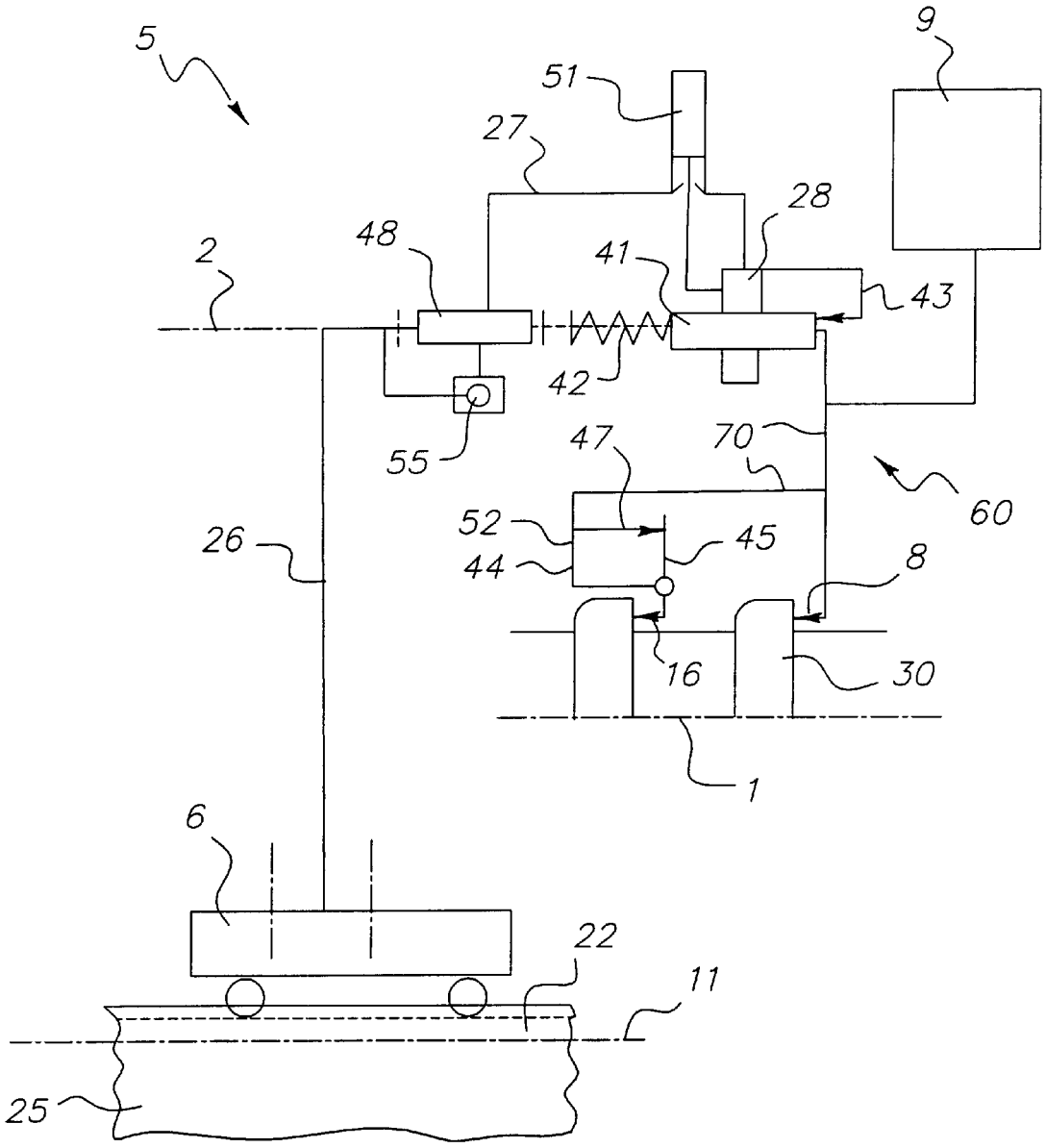
FIG. 4 represents a front schematic view, in the environment of the grinding machine, of the electromechanical control device according to a preferred embodiment of the invention.
Figure 5:
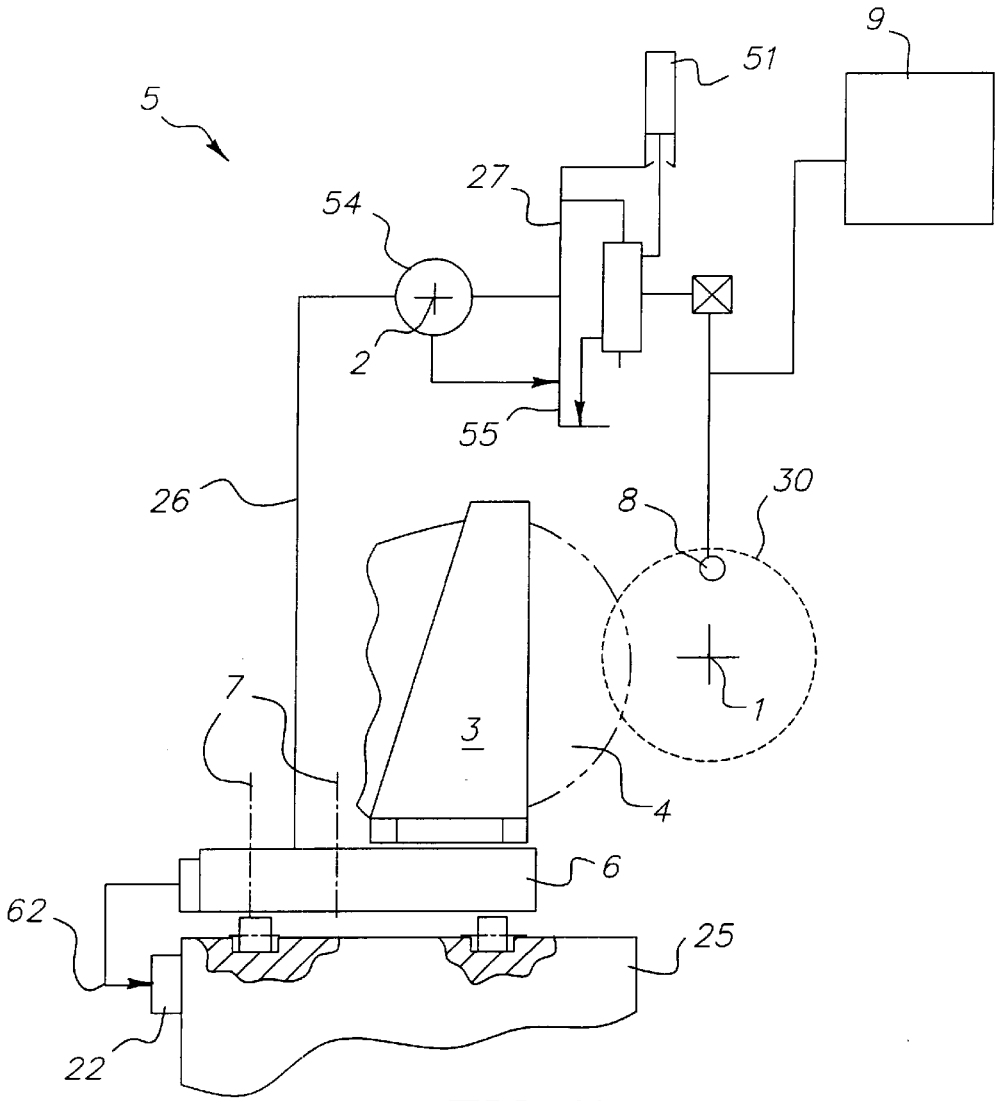
FIG. 5 represents a right hand schematic view of the device of FIG. 4.

By experience, slitters comprising the two knife shafts are stopped and disassembled after a set number of hours of use. The knife shafts are then ground on, for example, grinding type machines. The grinding precision required, in the order of several microns, demands much more precise machining than that obtained on a conventional lathe. To check the grinding, an electromechanical control device 5 suited to the grinding machine is used. This control device 5, of which an example is represented in FIGS. 4 and 5, is fixed on a carriage or longitudinal saddle 6 of the grinding machine, by fixing means 7 schematized by their axes. These means 7 can be, for example, fixing screws. The electromechanical control device 5 is equipped with a pair of position measuring sensors 43, 47, for example TESA type sensors known to those skilled in the art. Each sensor 43 and 47 comprises, for example, a diamond point type mechanical feeler 8, 16 that contacts the knife whose position is to be determined. The sensor pair 43, 47 is electronically linked to a set of control instruments 9 functioning together. The set of control instruments 9 comprises, for example, a galvanometer, and an electronic device that enables direct reading of the values in micrometers, their recording and the performance of calculations on the basis of preset calculation programs. The reading device is, for example, an LED display screen. The recording and calculation device can be a programmable logical controller equipped with a program and an appropriate memory. The carriage 6 of the grinding machine is generally motorized and moves in translation parallel to the axis 1 of the knife shaft to be ground. Apart from the control device 5 the carriage 6 takes a device 3 holding the grinding tool 4 for the knives 30. The device 3 is also fixed to the carriage 6. The grinding tool 4 of the knives can be, for example, a rotary grinding wheel 4; the rotation axis of this tool 4 is fixed on the tool-holder device 3. The knife shaft to be ground is fixed for example between points or in a mandrel on the grinding machine 25. The motorized carriage 6 allows low speed movement of the carriage comprising the tool-holder device 3, for example, in the order of 0.1 mm/min. This set of electromechanical components constitutes a relatively simple measuring and advance system, both easy to produce with standard material and very efficient; it enables sharpening passes of a few microns on the knives to be sharpened to be performed.

The electromechanical control device 5 enables the measuring of the differences of the actual position of the knives according to, for example, a chosen theoretical value Po of the pitch corresponding to the distance between two consecutive knives. According to FIGS. 4 and 5, the device 5 comprises a main support 26 fixed by the fixing means 7 to the longitudinal carriage 6 of the grinding machine 25. The main support 26 is solid with a mechanical arm 27 onto which is fixed a measuring assembly 60. The measuring assembly 60 comprises a first carriage 41 and a second carriage 28; the assembly can be moved along two practically orthogonal axes, one being parallel to the main axis 1 of the knife shaft.

In a preferred embodiment, the measuring assembly 60 comprises the second vertical carriage 28, solid with the arm 27; the second carriage 28 ensures by means of a device or upper element 51 the movement of the measuring assembly 60 in a direction practically perpendicular to the axis 1 of the knife shaft 40, 50 fixed on the grinding machine 25. The device 51 can be, for example, an actuator. According to the embodiment chosen, the first carriage 41 enables the movement of the measuring assembly 60 in the axis 1 of the knife shaft 40, 50. Movement of the first carriage 41 is ensured, for example, by a device comprising a horizontal actuator 48 and a spring 42. According to another embodiment without the second carriage 28, the first carriage 41 is directly solid with the arm 27. The second carriage 28 lets the measuring assembly rise or fall to correctly position the mechanical feelers 8, 16 on the face of the knifes to be checked. The movement of the first carriage 41 in relation to the arm 27, is practically parallel to the axis 1 of the knife shaft 40, 50. The position of the movement of the first carriage 41 is measured by a first high-precision sensor 43. In the preferred embodiment comprising the actuator 48 and the spring 42, the actuator 48 moves the first carriage 41 parallel to the axis 1, under the reverse action of the spring 42. This horizontal movement of the first carriage 41 enables the first mechanical feeler 8 of a fixed support 70 to be brought into contact with the face of the first knife. The feeler 8 is linked to the sensor 43. The feeler 8 which enables a stroke of a few millimeters in the axis 1 is linked for example to a galvanometer. After bringing the feeler 8 into contact with the first knife, the feeler 8 is made electrically zero. Then the control instrument 9 is initialized using a precision rule 22 as measurement reference. The rule 22 is itself electronically linked to the control instrument 9, in this sense that the translation movement in the axis 1 of the control device 5 comprising the measuring sensors and feelers 8, 16 is always done with reference to the rule. The precision rule 22 is fixed to the grinding machine 25, and its main axis 11 is parallel to the direction of movement of the carriage 6 in the axis 1 of the shaft to be ground. Preferably a glass rule calibrated with a resolution of 0.001 mm is used. The translation movements of the carriage 6 are always recorded with reference to this rule 22 with a measuring sensor 62. The rule remains fixed in relation to the carriage 6 which itself moves in translation. The initialization position serving as reference for the measurements to be carried out on the shaft to be ground is recorded in relation to the position of a first theoretical knife chosen as reference for the measurement of the length of the knife shaft 40, 50 between the two end knives. The reference value is initialized using a simple digital value, for example zero, and recorded as reference in the control instrument 9. Then the zero (reset) of the rule 22 is made to coincide with the sensor zero 8. Then, using the carriage 6, the sensor 8 is moved to the last knife that can be measured with the measuring assembly 60. This last knife is generally the one before last of the shaft; i.e. if the knife shaft comprises, for example 39 knives, generally the actual distance between the first and the thirty-eighth knife is measured. Once the feeler 8 is positioned at its electrical zero when it is in contact with the thirty-eighth knife, the actual length measured between the knives is read, with reference to the rule 22. This length is, for example, read directly on a digital display linked to the rule 22 and it is compared with the theoretical length. The theoretical length equals the total number of the theoretical pitch Po of the knife shaft 40, 50 multiplied by the value of the theoretical pitch Po along the knife shaft. This value of the theoretical pitch Po is generally constant. In certain embodiments, this value of the theoretical pitch can be slightly variable along the knife shaft, to take account of the entire manufacturing process.

The fixed support 70 onto which is fixed the feeler or diamond point 8 is solid with the first carriage 41; the fixed support 70 is fixed to the first carriage 41 and this fixed support 70 takes a measuring subassembly 44 fixed on the support 70. The subassembly 44 comprises a moving support 45, moving in relation to the fixed support 70. The relative position of the moving support 45 is measured by a second high-precision sensor 47, the sensor being fixed in relation to the fixed support 70. The sensor 47 enables measurement of the relative movement, in the axis 1, of the second diamond point 16 in relation to the first diamond point 8. The sensor 47, by means of a deforming mechanical device, measures the position of the moving support 45 determined by the contact between the second mechanical feeler 16 and the face of the second knife to be checked. The deforming mechanical device is, for example, a deforming spring leaf 52. The second mechanical feeler 16 in contact with the second knife of a first pair of checked knives, generates a second algebraic value that in relation to the first algebraic value of the first checked knife, indicates the algebraic difference of the length of the first pitch P measured in relation to the theoretical pitch Po. All these values are thus recorded knife by knife and serve as reference to determine the values for the quantities of material to be ground on the knives. Of course, the spacing or the distance between the two mechanical measuring feelers 8, 16 is initially preset, for example with a precision gauge block.

In a preferred embodiment, generally the value of the reference pitch is taken between the sensors 8, 16 equal to the value of the theoretical pitch Po. But it can also be contemplated in a downgraded embodiment to make the presetting of the pitch according to a reference pitch 19 on FIG. 3A; this reference pitch 19 is very close to the theoretical pitch Po and can be chosen arbitrarily on the shaft 50.

At the end of the checking operation of the first pair of knives, the actuator 48 moves the feelers 8, 16 slightly so that they are no longer in contact with the knives; then the feelers 8, 16 are disengaged by means of the upper element 51, to be far from the knives. According to a preferred embodiment of the device 5 according to the invention, a uniaxial articulation 54 equipped with a mechanical stop 55 enables the arm 27 taking the measuring assembly 60 to turn in relation to the main support 26, around the axis 2 of the articulation 54, and this in a direction of rotation removing the arm 27 from the mechanical stop 55. These kinematics facilitate the retraction of the control device assembly 5 so that the operations for putting into place and removing the knife shafts on the grinding machine are easier.

Figure 3A:
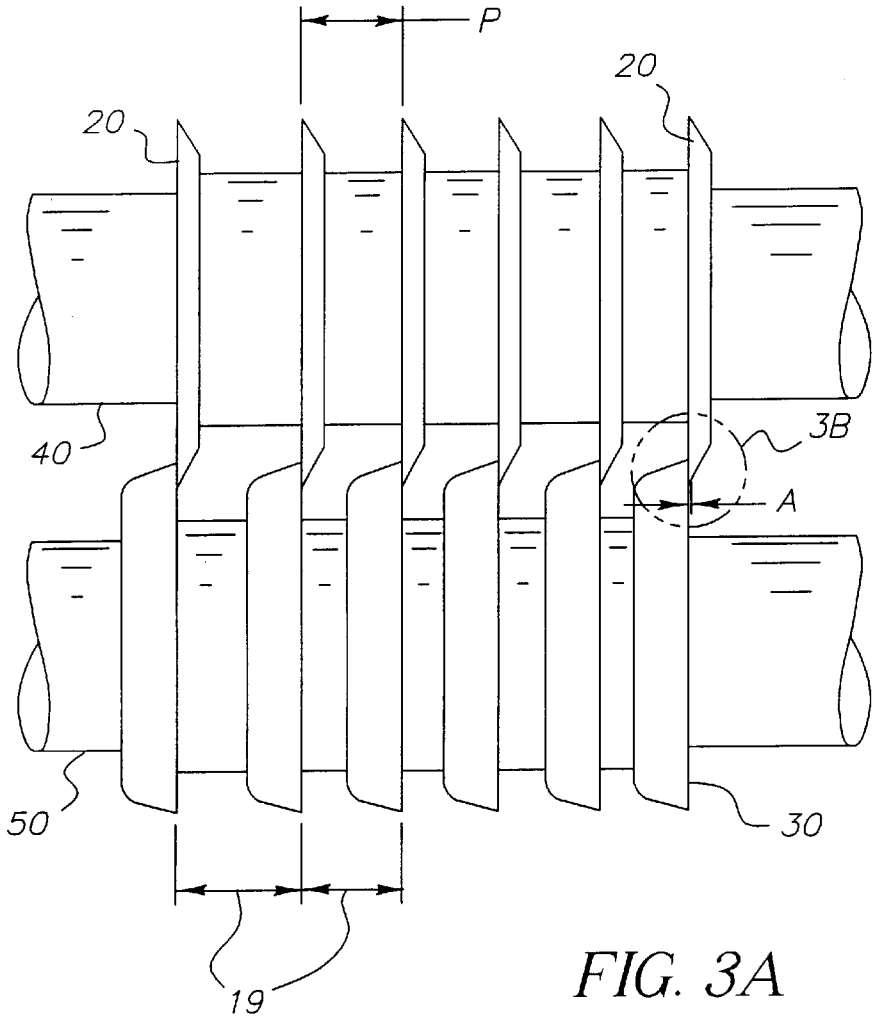
FIG. 3A represents a schematic view of the reference positioning of the knife shafts on the slitter.
Figure 3B:
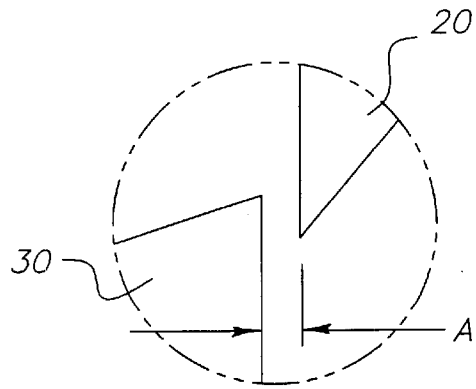
FIG. 3B represents a detail of FIG. 3A.

The pitch P between the knives as shown in FIG. 3A must be as constant as possible at least for the same pair of knife shafts, in order to ensure the cutting quality due in particular to a good pairing of the knife shafts 40, 50, i.e. good control of the play between knives and counter-knives represented by the dimension A. This control of the dimension A is due essentially to the reproducibility of the pitch P when sharpening. Actually, this pitch P is not constant because of the scatter due to conventional grinding processes, even if they were managed by numerical control means. The objective of the process according to the invention is to reduce the maximum difference between two pitches, and enable throughout the life of the knife shaft to remain in the tolerances or specifications required, by keeping good control of the variability of the cutting pitch P.

When the feelers 8, 16 of the sensors 43, 47 giving the algebraic difference of position of the first pair of checked knives are brought into contact with the surface of the knives to be checked, this in relation to the reference position initialized in relation to the rule 22, and recorded in the control instrument 9, it is considered that the sensor is in the control position to measure the position of the knives. From the values measured and recorded in the control instrument 9, values that represent the absolute position of the first pair of knives checked with reference to the rule 22, the relative difference of the knife consecutive to the first checked knife is measured and recorded relative to the reference pitch 19. The carriage is moved, always in relation to the reference position, itself initialized in relation to the precision rule 22, by a distance equal to the value of a theoretical pitch Po. This value of movement is, for example, read directly on the digital display screen. Then a second value corresponding to the position of the second pair of consecutive knives is recorded, i.e. situated immediately after the first pair of knives chosen. Thus the differences of position between the checked knives of the various knife pairs is recorded successively. This difference means on the one hand the relative difference in relation to the theoretical pitch, and on the other hand the differences of position of the checked knives in relation to the theoretical positions they should have. The values thus recorded are called algebraic, i.e. they can be positive, negative, or zero. Thus these measurements and recordings of the positioning of each knife are repeated successively, in relation to the reference pitch 19, from one knife to the next and so continuing to the last knife of the knife shaft to be checked. The process according to the invention then enables the determination of the average algebraic value of the difference per knife according to the sum of the algebraic differences thus recorded, then removing the average calculated value from each of the actual differences of positioning of the knives previously recorded. A first corrected relative position of each of the knives is thus obtained. Then, always with reference to the precision rule 22, the actual length of the shaft to be ground is measured, by measuring for example the actual distance between the two end knives. Based on the recorded position of the first knife, and always with reference to the precision rule 22, the position sensor is moved to the last knife of the shaft with the longitudinal carriage 6 comprising the control device 5 and the algebraic difference of the length of the shaft in relation to the theoretical length is recorded. Practically, if the feeler 8 serving as reference for the actual length measurement of the knife shaft is moved, with reference to the precision rule 22, the sensor 8 can only be positioned on the first knife and on the next to last knife of the shaft; the place of the last knife is generally occupied by the second sensor 16. This specified theoretical length for each knife shaft type corresponding to the strip widths of the various films is recorded, for example, in a data file of the device 9. A knife shaft comprising, for example, 39 knives and intended to cut film strips with a width of 35 mm will have a total theoretical length LT=38×35=1330 mm.

Figure 6:
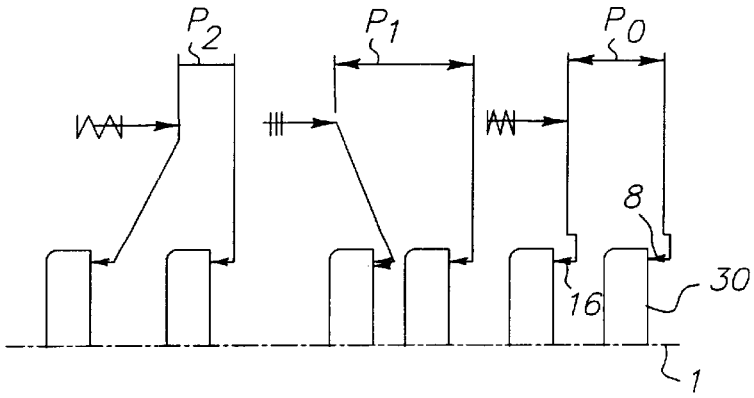
FIG. 6 represents the positioning of the position measuring sensors of the control device in relation to the knives according to a preferred embodiment of the invention.

The process according to the invention enables calculation of the algebraic difference for the length per knife, by calculating the algebraic difference between the actual length obtained by moving the corresponding measuring position sensor to the positions of the two knives placed at the ends of the shaft to be ground, and the specified total theoretical length. The process according to the invention adds the difference for the length per knife to the first corrected relative position of each of the knives, and thus a second corrected relative algebraic position of each of the knives is obtained. From the algebraic sum of the values of the second corrected relative position of each of the knives, the process according to the invention thus displays the values of the material to be removed per knife. The values of material to be removed per knife are obtained from these accumulated algebraic values of the second values corresponding to the corrected relative position of each knife. The highest positive algebraic value thus found corresponds to the knife for which there is no material to be removed, and inversely, the negative algebraic value with the greatest absolute value corresponding to the knife for which there is the most material to be removed. In practice, the difference between these two end values is a few tens of micrometers, i.e. some hundredths of millimeters. The actual values to be removed on each of the other knives is obtained, by removing from the algebraic value with the greatest absolute value found, each of the other individual calculated accumulated values of the second relative position. Generally, for reasons inherent in obtaining good grinding quality, a fixed value has to be added to each of the calculated accumulated values of the second corrected relative positions; the fixed value to be added depends on the grinding conditions and especially the dimensional characteristics of the material of the knives to be ground. In practice, this enables for example making two or three grinding passes per knife, by planning a first blank pass that can for example be zero, i.e. there is no material to be removed for part of the shaft's knives, and only representing a few micrometers for the rest of the knives. This then ensures good quality and good evenness of the following passes; the final pass for example is uniform and 20 micrometers for each of the shaft's knives. A preferred embodiment of the implementation of the process according to the invention enables making knife checks by using the two sensors 43, 47 simultaneously to take the measurements for a given pair of knives of the knife shaft. According to FIG. 6, these sensors 43, 47 are placed on the control device 5 on board the carriage 6 so that they are positioned preset one in relation to the other, for example, at a distance P0 equal to the value of the theoretical pitch of the knife shaft. The value of the theoretical pitch is preset on the device 5 holding the sensors 43, 47 and equals the distance P0 separating the two sensors 43, 47. According to FIG. 6 the reference position of the sensors is the position of their initial presetting meaning the distance P0 between these two sensors. The device 5 holding the sensors 43, 47 moves in translation parallel to the axis 1 of the knife shaft. The device 5 holding the sensors 43, 47 enables the sensors to be removed from the shaft, to move them from pitch to pitch along the shaft. Further, to be able to measure conveniently the measured differences, the two sensors 43, 47 held by the device 5 can move relatively one in relation to the other in the axis 1 of the knife shaft, under the effect of a low mechanical force exerted in the direction of the axis 1. This distance P0 is measured according to a line parallel to the axis 1 of the shaft to be ground. The actual pitch between the two knives checked simultaneously can take the value P0 if the actual pitch equals the theoretical pitch P0, the value P1 if the actual pitch is greater than the theoretical pitch, or the value P2 if the actual pitch is smaller than the theoretical pitch. The various positions encountered when measuring the distance differences between pairs of consecutive knifes are shown in FIG. 6. Checking the first two consecutive knives situated, for example, at the end of the knife shaft by using the pair of preset sensors enables the values of the differences in relation to the reference position previously initialized of the corresponding theoretical knives on the knife shaft to be obtained.

The example shown in the table of Annex I concerns a knife shaft 40, 50 comprising 39 knives and 38 different pairs of consecutive knives enabling the cutting of 38 film strips. The first knife N° 0 serving as starting reference for the check is not mentioned in the table; i.e. the knife N° 1 is the second knife of the knife shaft 40, 50 and the knife N° 38 is the thirty-ninth knife of said knife shaft.

To implement the process according to the invention, the preset sensors 8, 16, for example, are brought into contact with the first two consecutive knives of the shaft. The algebraic value of the difference read for example on a galvanometer is +1 (first line of Knife No column of the table). This difference +1 expresses the difference in micrometers of the first actual pitch checked on the first pair of knives 20, 30 of the knife shaft 40, 50 in relation to the theoretical pitch, or even to a reference pitch 19 chosen very close to the theoretical pitch. The first actual pitch checked also shows that the second knife N° 1 is offset by +1 in relation to its theoretical position on the knife shaft 40, 50; this in relation to the reference knife N° 0 (not mentioned in the table).

Figure 7:
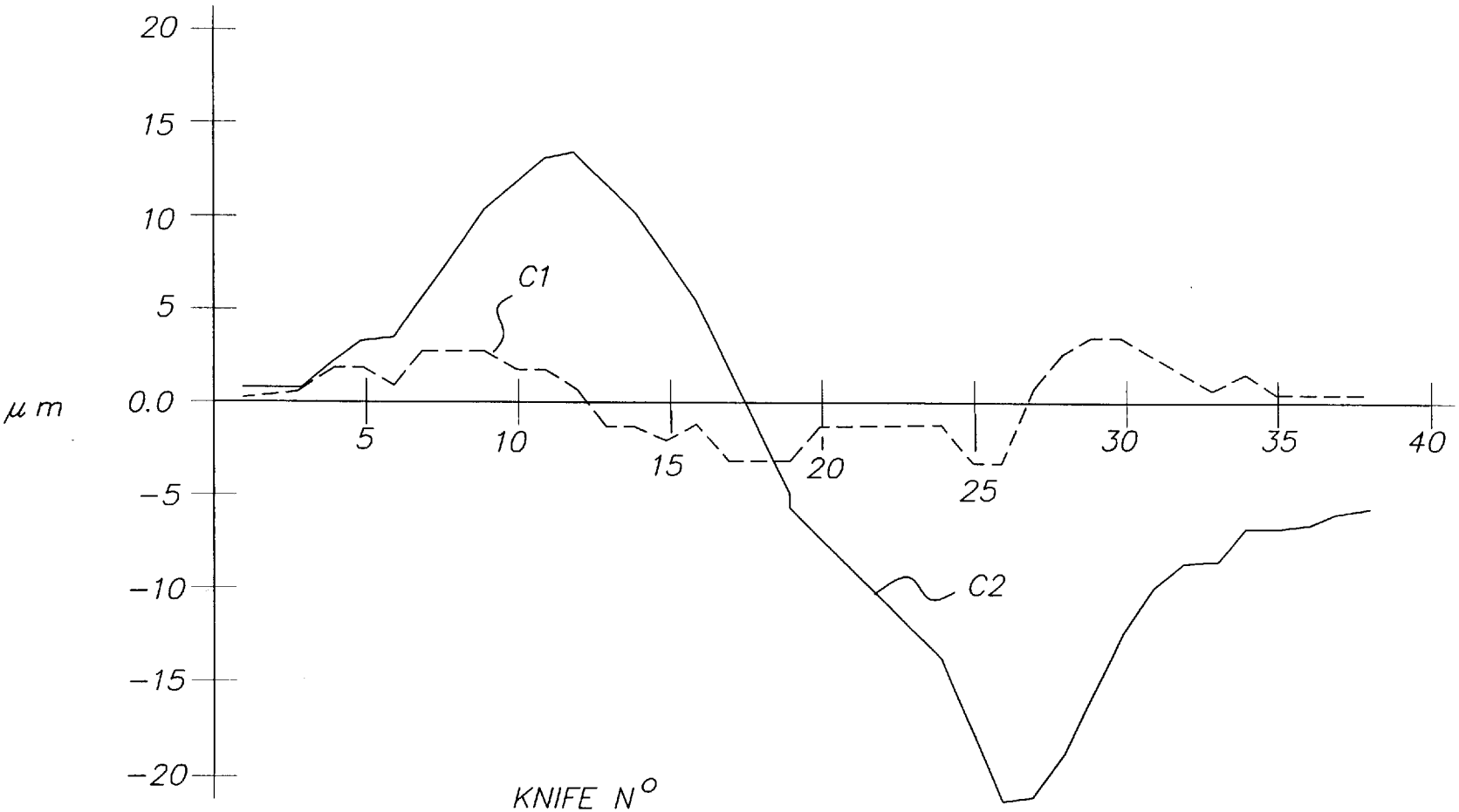
FIG. 7 is a graphic representation corresponding to the values of the table attached in Annex I.

After having moved in the axis 1 the measuring assembly 60 by a distance approximately equal to the pitch value, then for example the second pair of consecutive knives formed by the knives N° 1 and N° 2 is checked. The algebraic value of the difference read is again +1 (second line of Knife No column of the table). This difference +1 means that the difference of the second actual pitch checked on the second pair of knives is +1 in relation to the theoretical pitch. This difference +1 also means that the third knife N° 2 is offset by +2 (+1+1) in relation to its theoretical position. The example of the ninth knife N° 8 shows that the pitch checked between the seventh and eighth knife is offset by +3 in relation to the theoretical pitch and implicitly means that the knife N° 8 is offset by +14 in relation to its theoretical position; +14 is the algebraic value of the sum of all the recorded differences (Knife N° column of the table). Thus pitch by pitch, i.e. for each pair of consecutive knives, the value of the difference of the actual position of each of the knives 20, 30 in relation to a reference position taken with regard to the first knife N° 0 of the knife shaft 40, 50 is determined; the difference of the actual position of each of the knives is defined in relation to the theoretical position of the knives; this difference is determined for each different pair, generally each successive pair of consecutive knives, by the algebraic value of the difference between the actual pitch between the consecutive knives and the theoretical pitch P0 or reference pitch 19 by default. The algebraic values of the differences between the actual pitches and the theoretical pitch are shown in column 1 of the table and by the curve C1 of FIG. 7. Then the average algebraic value of the previously determined differences is determined. For this, the differences are summed and divided by the total number of different pitches or pairs of consecutive knives of the knife shaft 40, 50. For example, the algebraic sum of the differences of column 1 of the table is +21; the total number of knife pairs is 38; the average algebraic value of said differences is calculated by dividing +21 by 38, which gives approximately an average algebraic value of +0.6. From this value of +0.6 a first corrected relative position of each of the knives is determined by removing said average algebraic value from each of the individual values of the differences obtained in the previous step (column 1 of the table of Annex I). This operation leads to the data of column 2 of the table. For example, for the second knife N° 1, the following is obtained:

+1−0.6=+0.4; for the sixteenth knife N° 15, the following is obtained: −2−0.6=−2.6.

To refine the correction, a second corrected relative position of each of the knives is determined, by adding the algebraic value of the difference for the length per knife to the algebraic values corresponding to the first corrected relative position. The algebraic difference for the length per knife is obtained from the value of the actual length of the shaft to be ground, generally measured between the two end knives of the knife shaft 40, 50. Firstly the algebraic value of the difference between the total theoretical length of the knife shaft and the corresponding total actual length between the two end knives of the knife shaft is determined. The total theoretical length LT is calculated by multiplying the total number of different pairs of consecutive knives of the knife shaft by the value of the theoretical pitch P0. The algebraic value of the difference for the length per knife is determined by dividing the algebraic value giving the difference between the theoretical length and the corresponding actual length by the corresponding number of knife pairs. If one takes the total number of pitches or pairs of consecutive knives of a knife shaft 40, 50 enabling 38 film strips to be cut, the number of corresponding knives will be 39. But, for reasons linked to the operating conditions of use of the measuring assembly 60 comprising the two feelers 8, 16, an actual length can be determined by using the feeler 8 with reference to the precision rule 22, which is close but less than the total length between the two end knives. The theoretical length LT is, for example, calculated for 37 pitches or knife pairs; if the specified theoretical pitch is, for example 34.958 mm, the theoretical length will be 1293.446 mm (34.958×37); the number of knives corresponding to these 37 pitches will be 38.

The actual length LR measured for 37 pitches is for example 1293.442 mm. The algebraic difference for the length per knife is determined by the formula:

$$\frac{LR-LT}{\text{Number of Knife Pairs}}$$

In an example an approximate algebraic value of the difference for the length per knife of −0.1 micrometer is obtained.

$$\frac{1293.442-1293.446}{38}=-0.1$$

Then the algebraic value of a second corrected relative position of each knife is determined by adding the algebraic value of the difference for the length per knife to the algebraic values of the first corrected relative position (column 2 of the table). Thus column 3 of the table of Annex I is obtained that corresponds to the algebraic values of the second corrected relative positions of the knives. For example, the value of the second corrected relative position of the second knife N° 1 is: +0.4−0.1=+0.3; that of the thirty-first knife N° 30 is: +3.4−0.1=+3.3.

Then, based on these successive corrections, the algebraic sum of the values obtained in the column 3 is determined to obtain the actual positions of the knives along the knife shaft, in relation to their respective theoretical positions. This sum corresponds to the column 4 of the table of Annex I and the curve C2 of FIG. 7. The positive algebraic values correspond to the knives for which there is the least material to be removed, the greatest value 13.6 for the thirteenth knife N° 12, corresponding for example, to the knife for which no material at all is removed, and the lowest value −21.2 for the knife N° 26, corresponding to the knife for which there is the most material to be removed; the value to be removed for this knife N° 26 being the difference in absolute value between the two end values of the column 4; in our example

+13.6−(−21.2)=34.8.

This means that if, for example, one chooses not to remove material from the knife N° 12, 34.8 micrometers is removed from the knife N° 26. For example 13.6−(3.8)=9.8 is removed from the knife N° 6. Thus the material to be removed for each of the knives is determined. The first knife N° 0 of the knife shaft not shown in the table is ground by the same value as the knife N° 1 to which the average algebraic value of the differences between the actual pitches and the theoretical pitch. The average algebraic value being obtained by dividing the algebraic sum of the differences of column 1 of the table by the total number of knife pairs.

According to a variant of this last embodiment aiming to grind all the knives 20, 30 of the knife shaft 40, 50, clearly it can be contemplated to grind a finite number of knives less than the total number of knives of the knife shaft. Also according to column 5 of the table, to improve the grinding operating conditions and ensure that all the knives are sharpened, an additional value, for example, 20 micrometers can be added to the value to be removed per knife; this additional value is systematically removed during the last sharpening pass for all the knives 20, 30 of the knife shaft 40, 50. This way of proceeding enables, while grinding the knives, keeping both the good geometric positioning of the knives and a constant pitch all along the shaft to be ground independently of surrounding physical phenomena and especially the temperature variations around the grinding machine.

It can be contemplated to grind in one or more passes per knife. Columns 6 to 8 of the table constitute an example where the knives are ground in three successive passes by systematically removing 20 micrometers from each knife during the third and last grinding pass. Of course, during the first grinding pass (column 6 of the table), a good number of knives where no material is removed are found.

A slightly downgraded variant of the process according to the invention, but nevertheless giving very acceptable results, does not take into account the algebraic value of the difference for the length per knife.

One implemented variant of the preferred embodiment includes applying the process according to the invention for grinding the knives 20, 30 by taking into account the variability of the manufacturing process and the physical characteristics of the photographic film strip to be cut by choosing not a uniform value P0 of the theoretical pitch along the axis 1 of the knife shaft 40, 50, but by choosing a slightly variable pitch Po+ΔPo, for example, for the knife pairs situated at each end of the knife shaft 40, 50. ΔPo can increase or decrease linearly or follow a non-linear function. Thus strips of widths slightly different in a range corresponding to the variations of width of the strips of about 0.05 mm could be cut using the same knife shaft. In general numeric data relative to the first shaft of the slitter 10 are used to grind the second shaft of said slitter, in order to ensure good pairing of the two knife shafts 40, 50 working together.

Clearly any other arrangement of the elements of the control device in relation to the grinding machine and the knife shaft to be ground can be contemplated, in so far as they enable the process according to the invention to be produced.

The invention has been described in detail with particular reference to certain preferred embodiments thereof, but it will be understood that variations and modifications can be effected within the spirit and scope of the invention.

ANNEX I

| Knife N° | 1 | 2 | 3 | 4 | 5 | 6 | 7 | 8 |
|---|---|---|---|---|---|---|---|---|
| 1 | 1 | 0.4 | 0.3 | 0.3 | 33.3 | 0 | 13.3 | 20 |
| 2 | 1 | 0.4 | 0.3 | 0.6 | 33.0 | 0 | 13.0 | 20 |
| 3 | 1 | 0.4 | 0.3 | 0.9 | 32.7 | 0 | 12.7 | 20 |
| 4 | 2 | 1.4 | 1.3 | 2.2 | 31.4 | 0 | 11.4 | 20 |
| 5 | 2 | 1.4 | 1.3 | 3.5 | 30.1 | 0 | 10.1 | 20 |
| 6 | 1 | 0.4 | 0.3 | 3.8 | 29.8 | 0 | 9.8 | 20 |
| 7 | 3 | 2.4 | 2.3 | 6.1 | 27.5 | 0 | 7.5 | 20 |
| 8 | 3 | 2.4 | 2.3 | 8.4 | 25.2 | 0 | 5.2 | 20 |
| 9 | 3 | 2.4 | 2.3 | 10.7 | 22.9 | 0 | 2.9 | 20 |
| 10 | 2 | 1.4 | 1.3 | 12.0 | 21.6 | 0 | 1.6 | 20 |
| 11 | 2 | 1.4 | 1.3 | 13.3 | 20.3 | 0 | 0.3 | 20 |
| 12 | 1 | 0.4 | 0.3 | 13.6 | 20.0 | 0 | 0 | 20 |
| 13 | −1 | −1.6 | −1.7 | 11.9 | 21.7 | 0 | 1.7 | 20 |
| 14 | −1 | −1.6 | −1.7 | 10.2 | 23.4 | 0 | 3.4 | 20 |
| 15 | −2 | −2.6 | −2.7 | 7.5 | 26.1 | 0 | 6.1 | 20 |

-continued

ANNEX I

| Knife N° | 1 | 2 | 3 | 4 | 5 | 6 | 7 | 8 |
|---|---|---|---|---|---|---|---|---|
| 16 | −1 | −1.6 | −1.7 | 5.8 | 27.8 | 0 | 7.8 | 20 |
| 17 | −3 | −3.6 | −3.7 | 2.1 | 31.5 | 0 | 11.5 | 20 |
| 18 | −3 | −3.6 | −3.7 | −1.6 | 35.2 | 0 | 15.2 | 20 |
| 19 | −3 | −3.6 | −3.7 | −5.3 | 38.9 | 0 | 18.9 | 20 |
| 20 | −1 | −1.6 | −1.7 | −7.0 | 40.6 | 0.6 | 20 | 20 |
| 21 | −1 | −1.6 | −1.7 | −8.7 | 42.3 | 2.3 | 20 | 20 |
| 22 | −1 | −1.6 | −1.7 | −10.4 | 44.0 | 4.0 | 20 | 20 |
| 23 | −1 | −1.6 | −1.7 | −12.1 | 45.7 | 5.7 | 20 | 20 |
| 24 | −1 | −1.6 | −1.7 | −13.8 | 47.4 | 7.4 | 20 | 20 |
| 25 | −3 | −3.6 | −3.7 | −17.5 | 51.1 | 11.1 | 20 | 20 |
| 26 | −3 | −3.6 | −3.7 | −21.2 | 54.8 | 14.8 | 20 | 20 |
| 27 | 1 | 0.4 | 0.3 | −20.9 | 54.5 | 14.5 | 20 | 20 |
| 28 | 3 | 2.4 | 2.3 | −18.6 | 52.2 | 12.2 | 20 | 20 |
| 29 | 4 | 3.4 | 3.3 | −15.3 | 48.9 | 8.9 | 20 | 20 |
| 30 | 4 | 3.4 | 3.3 | −12 | 45.6 | 5.6 | 20 | 20 |
| 31 | 3 | 2.4 | 2.3 | −9.7 | 43.3 | 3.3 | 20 | 20 |
| 32 | 2 | 1.4 | 1.3 | −8.4 | 42.0 | 2.0 | 20 | 20 |
| 33 | 1 | 0.4 | 0.3 | −8.1 | 41.7 | 1.7 | 20 | 20 |
| 34 | 2 | 1.4 | 1.3 | −6.8 | 40.4 | 0.4 | 20 | 20 |
| 35 | 1 | 0.4 | 0.3 | −6.5 | 40.1 | 0.1 | 20 | 20 |
| 36 | 1 | 0.4 | 0.3 | −6.2 | 39.8 | 0 | 19.8 | 20 |
| 37 | 1 | 0.4 | 0.3 | −5.9 | 39.5 | 0 | 19.5 | 20 |
| 38 | 1 | 0.4 | 0.3 | −5.6 | 39.2 | 0 | 19.2 | 20 |

LR = 1293.442
LT = 1293.446

What is claimed is:

1. A grinding process for knives placed on a periphery of a knife shaft, the process comprising the steps of:

(a) defining a difference of an actual position of each of the knives in relation to a reference position corresponding to a theoretical position of said knives, by determining an algebraic value of a difference between an actual pitch measured between two consecutive knives and a theoretical pitch for each different pair of consecutive knives of the knife shaft;

(b) calculating an average algebraic value of the algebraic values of the differences between the actual pitch and the theoretical pitch determined at said step (a), by dividing a sum of said algebraic values of the differences by a total number of different pairs of consecutive knives of the knife shaft;

(c) determining an algebraic value corresponding to a first corrected relative position of each of the knives, by removing said average algebraic value of the differences calculated at said step (b) from each of the algebraic values of the difference between the actual pitch and the theoretical pitch determined at said step (a);

(d) determining an algebraic value of a difference between a total actual length between the two end knives of the knife shaft, and a total theoretical length of the knife shaft calculated by multiplying the total number of different pairs of consecutive knives by the value of the theoretical pitch;

(e) determining an algebraic value of the difference for the length per knife by dividing the algebraic value of the difference between the total theoretical length and the total actual length obtained at said step (d) by the total number of knife pairs of the knife shaft;

(f) determining an algebraic value corresponding to a second corrected relative position of each of the knives by adding the algebraic value of (g) the difference for the length per knife to the algebraic values corresponding to the first corrected relative position; and (h) from the sum of the algebraic values of the second corrected relative position, determining quantities of material to be removed per knife.

2. A grinding process according to claim 1, wherein the value of the pitch is chosen slightly variable along the knife shaft.

3. A process according to claim 1, wherein after the calculation of the actual values to be removed for each of the knives, a finite number of knives of the knife shaft are chosen to be ground less than the total number of knives of said knife shaft, said knives to be ground being separated by a distance equal to one or more pitches along the axis of the knife shaft.

4. A process according to claim 1, wherein integrated into the calculation of the actual values to be removed for each of the knives obtained at said step (g), is an additional fixed value that is added to the values obtained at said step (g).

5. A process according to claim 1, wherein the first checked knife pair is situated at one of the ends of the knife shaft.

6. A process according to claim 1, wherein the first checked knife pair is situated anywhere on the knife shaft.

7. A process according to claim 1, wherein the value of the algebraic difference for the length per knife obtained at said step (e) is not taken into account.

8. A process according to claim 1, wherein to determine the algebraic value of the difference for the length per knife, a number of different pairs of consecutive knives less than the total number of said pairs and a number of knives equal to said number of different pairs of knives increased by one are chosen.

* * * * *